US005482436A

United States Patent [19]

Bohanon, Sr.

[11] Patent Number: 5,482,436

[45] Date of Patent: Jan. 9, 1996

[54] HIGH SPECIFIC SPEED FAN PROPELLER HAVING AUXILIARY BLADES

[75] Inventor: Hoy Bohanon, Sr., Muskogee, Okla.

[73] Assignee: Acme Engineering & Manufacturing Corp., Muskogee, Okla.

[21] Appl. No.: 175,622

[22] Filed: Dec. 30, 1993

[51] Int. Cl.[6] ..... F04D 29/32

[52] U.S. Cl. ..... 416/203; 416/200 R; 416/201 A

[58] Field of Search ..... 416/203, 201 A, 416/200 R, 175, DIG. 3

[56] References Cited

U.S. PATENT DOCUMENTS

| | | | |
|---|---|---|---|
| 1,485,788 | 3/1924 | Lamwers . | |
| 1,831,729 | 11/1931 | Adamcikas et al. | 416/203 |
| 1,946,571 | 2/1934 | Briner . | |
| 2,238,749 | 4/1941 | Peltier | 416/203 |
| 2,353,681 | 7/1944 | Martin et al. . | |
| 5,328,335 | 7/1994 | Monroe | 416/203 |

FOREIGN PATENT DOCUMENTS

| | | | |
|---|---|---|---|
| 483057 | 9/1929 | Germany | 416/203 |
| 32808 | 3/1979 | Japan | 416/203 |

*Primary Examiner*—Edward K. Look
*Assistant Examiner*—James A. Larson
*Attorney, Agent, or Firm*—Staas & Halsey

[57] ABSTRACT

A high specific speed fan propeller is provided which has a hub, at least two main blades and at least two auxiliary blades. The hub has an attachment device for connecting the propeller to a turning part. The at least two main blades are attached to the hub and extend radially a first distance therefrom. The at least two auxiliary blades are also attached to the hub and extend radially a second distance therefrom. The first distance is greater than the second distance.

7 Claims, 2 Drawing Sheets

HIGH SPECIFIC SPEED FAN PROPELLER HAVING AUXILIARY BLADES

BACKGROUND OF THE INVENTION

1. Field of the Invention

The present invention relates to high specific speed fan propellers in general and more particularly to commercial direct drive fan propellers used for ventilation.

2. Description of the Related Art

In a fan which is used to move air, it is important that there be generally uniform pressure and velocity across all areas of the propeller disc. Output power is the product of volume flow through the fan orifice and the increase in total pressure. Uniform pressure minimizes kinetic energy losses. More particularly, if the pressure change is less at one area of the propeller disk, for example, near the hub, there may be backflow at that area.

The pressure developed depends on the square of the velocity. The velocity of a blade is much greater at the tip than at the root due to the difference in diameter. In the past, many commercial fans were belt driven which enabled the speed of the blade to be easily controlled. However, the additional parts necessary for a belt driven fan are associated with problems such as belts breaking and tension problems. Therefore, a direct drive fan is desirable. With a direct drive fan, it is difficult to control the speed. The speed of an electric motor for 60 cycle current is equal to 7,200 divided by the number of poles. The load on the motor will slightly decrease this synchronous speed. With an eight pole motor, the approximate speed, taking into account speed reduction due to the fan load, is approximately 800 RPM. This speed is significantly greater than the previous belt driven speeds.

By increasing the speed of the blade, the tip area of the blade must be decreased. To keep sufficient pressure near the hub, it would be desirable to have the blade be much wider near the hub. However, the resulting blade shape is not practical, as difficulties in twisting the blade result.

In the field of airplane propellers, it has been proposed to supplement the blade area near the hub by adding auxiliary blades. Although the appearance of an airplane propeller may be somewhat similar to that of a high specific speed fan propeller, the two are very different. Airplane propellers are designed to operate at a high air velocity through the disk, around 15,000 feet per minute. This higher velocity allows the angle which the blades make with the disk of rotation to be greater than that of fan blades. For example, the angle an airplane blade makes with the disk of rotation is approximately 25°.

Moreover, the function of a airplane propeller is very different from that of a commercial high specific speed fan. The airplane propeller's function is to develop thrust, not pressure. The output power of an airplane propeller is the product of a propeller's thrust and the airplane velocity. The propeller's thrust is the sum of the pressure differential of each blade increment from the blade hub to the blade tip. Further, the function of the airplane propeller near the hub is not critical. In an airplane propeller there is no need for uniform pressure addition. If the pressure addition is less near the hub, the performance of the propeller is not significantly impaired. Because uniform pressure addition is not critical, it is possible to make a useful airplane propeller with a simple blade root. In a simple blade root, the function of the blade root is mainly to support the rest of the blade, not to add pressure. Airplane propellers are generally forged and have a thick blade root with poor aerodynamic qualities.

In a fan propeller, the aerodynamic qualities of the blade near the hub need to be quite good. The fan blade is often made of sheet metal having uniform thickness so that the blade functions near the root in a manner similar to how it functions near the tip.

SUMMARY OF THE INVENTION

It is object of the present invention to provide a high specific speed fan propeller in which backflow does not occur.

More specifically, it is an object of the present invention to provide a high specific speed fan propeller in which the pressure differential is generally uniform over the area of the disk of rotation.

It is a further object of the present invention to provide a high specific speed fan propeller which is easy to fabricate.

It is a yet further object of the present invention to provide a high specific speed fan propeller which is weight stabilized and can be directly driven.

According to the present invention, a high specific speed fan propeller is provided which has a hub, at least two main blades and at least two auxiliary blades. The hub has an attachment means for connecting the propeller to a turning part. The at least two main blades are attached to the hub and extend radially a first distance therefrom. The at least two auxiliary blades are also attached to the hub and extend radially a second distance therefrom. The first distance is greater than the second distance.

DETAILED DESCRIPTION OF THE PREFERRED EMBODIMENTS

Figure 1:
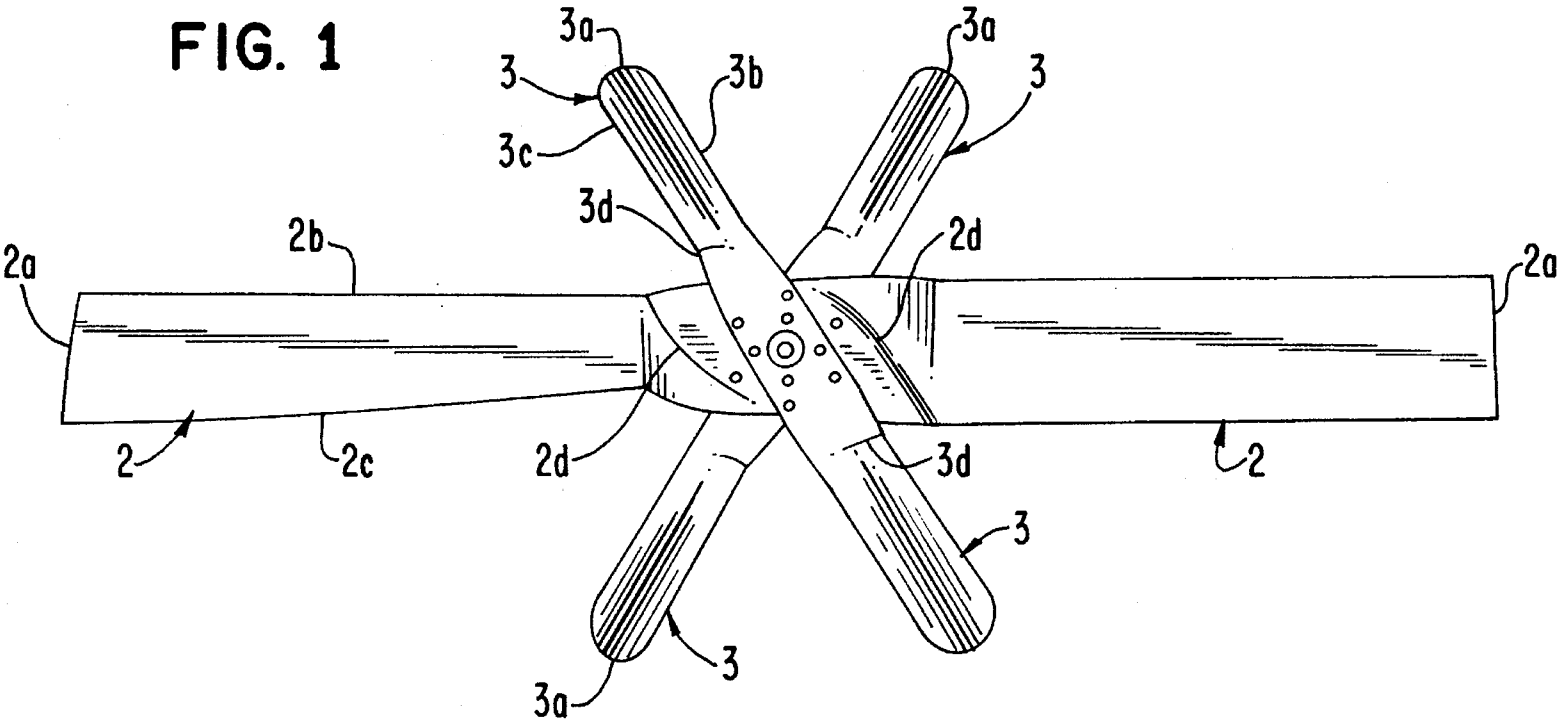
FIG. 1 is a plan view of a propeller according to the present invention.

The present invention will now be described with reference to the accompanying drawings. In the drawings, like reference numerals represent like elements, and, as such, the description thereof is not repeated, where appropriate.

Figure 3:
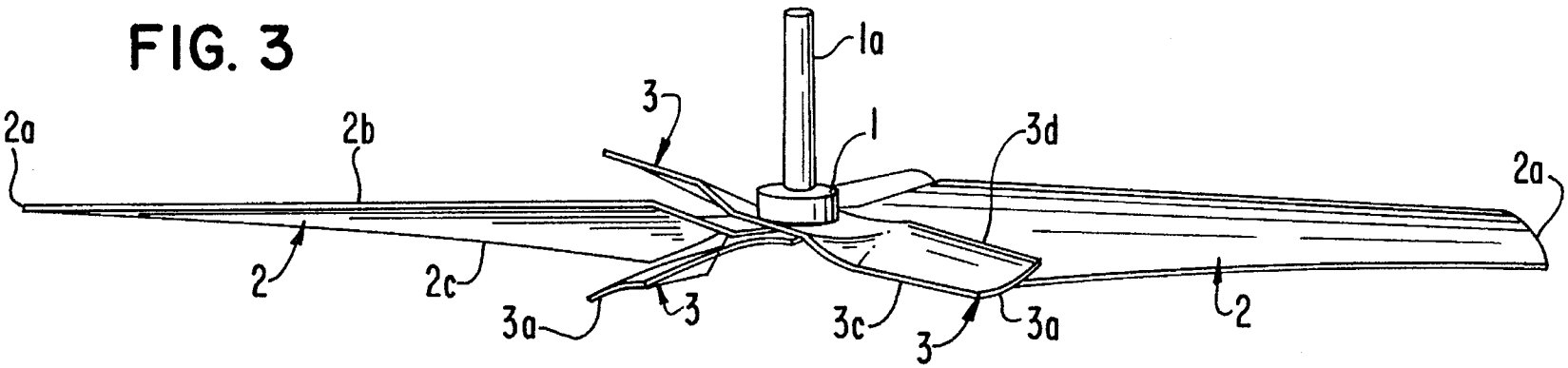
FIG. 3 is a side view of a high specific speed fan propeller according to the present invention.
Figure 2:
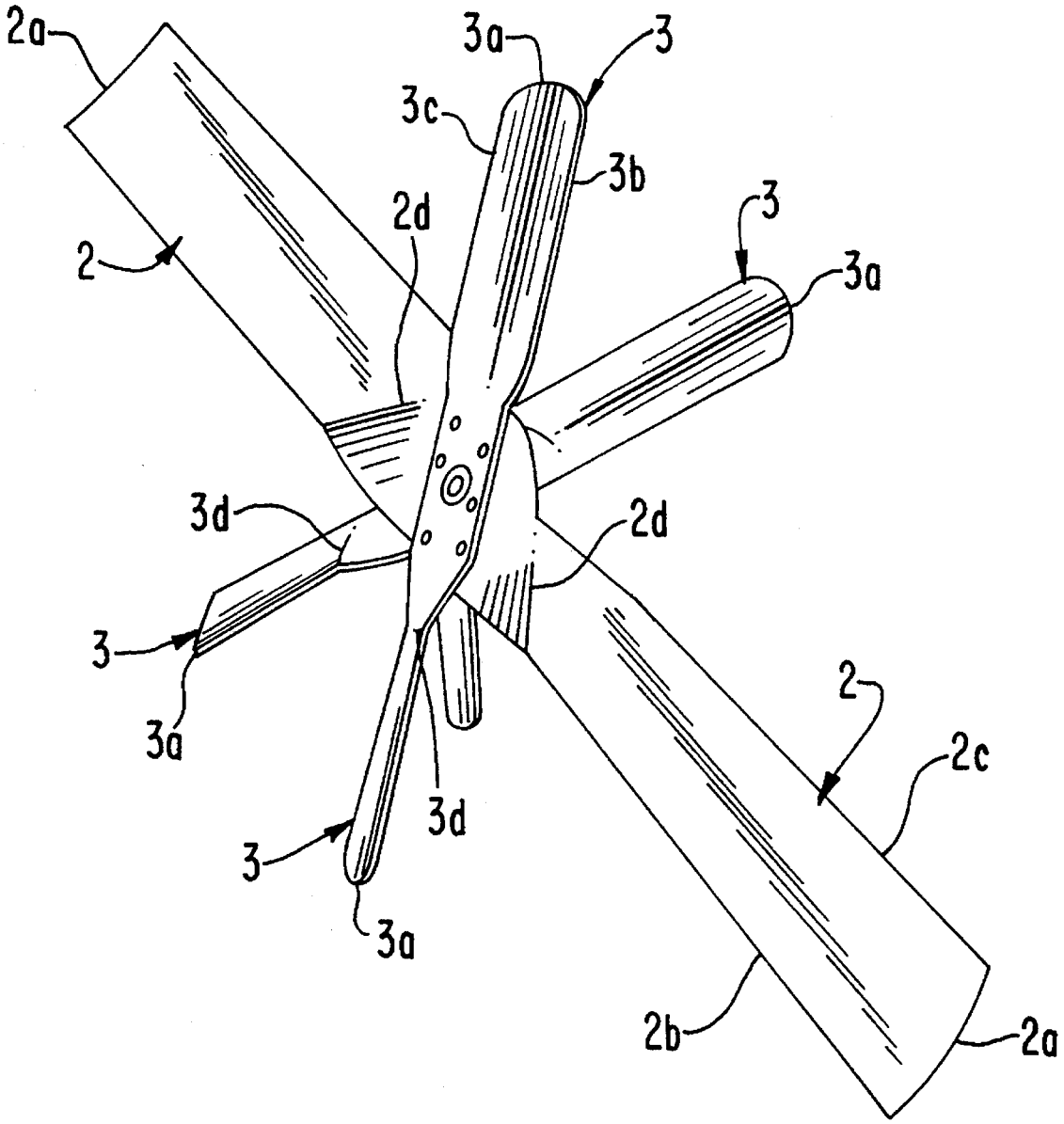
FIG. 2 is a perspective view of a high specific speed fan propeller according to the present invention.

FIGS. 1, 2 and 3 are respectively a plan view, a perspective view, and a side view of a high specific speed fan propeller according to the present invention. Such a high specific fan is used commercially, for example to cool large poultry houses which may be as large as 60' by 500' and house as many as 100,000 birds. As can be seen in the Figures, the high specific speed fan propeller has a hub 1 to which all blades are attached. The hub 1 includes attachment means la for connecting the propeller to a turning part. In the case of the present invention, the turning part is a direct drive motor. The fan propeller has at least two main blades 2 attached to the hub 1 and extending radially a first distance therefrom. The fan propeller also has at least two auxiliary blades 3 attached to the hub 1 and extending radially a second distance therefrom. The first distance is greater than the second distance. As can be seen from the Figures, the fan propeller preferably has two main blades 2 and four auxiliary blades 3. The blades 2, 3 are made of sheet metal and preferably of steel sheet metal. Each main blade 2 has a corresponding main blade 2 extending in an opposite direction from the hub 1 and each auxiliary blade 3 has a corresponding auxiliary blade 3 extending in an opposite direction from the hub 1. As can be seen more clearly from the plan and prospective views, FIGS. 1 and 2 respectively, each pair of corresponding auxiliary and main blades is formed from a piece of sheet metal having a middle portion which is attached to the hub 1. This single piece of sheet metal extends from the tip of one blade 2*a*, 3*a* to the tip 2*a*, 3*a* of the corresponding blade. After the blades 2, 3 are cut to the appropriate size, they are shaped by molding them around a cone shaped object. The base of the cone is used to form the tip 2*a*, 3*a* of the blade, and the top of the cone is used to form the portion near the hub 1. In this manner, a "twist" is put in each blade 2, 3. The cord is an imaginary line connecting a trailing edge 2*c*, 3*c* of the blade with a leading edge 2*b*, 3*b* of the blade. The cord makes an angle with the disk of rotation. A first angle with the disk of rotation is made at the tip 2*a*, 3*a* of the blade and a second angle is made with the disk of rotation toward the hub 1. The second angle is greater than the first angle. As can be seen in the side view of FIG. 3, the blades 2,3 gradually taper so that the angle the cord makes with the disk of rotation gradually changes from the second angle towards the hub 1 to the first angle at the tip 2*a*, 3*a*. For example, the second angle may be 35° towards the hub 1, and the first angle may be 15° towards the tip.

Although using a cone shaped object to form the blade simplifies the shaping process, shaping is still required to form a crease 2*d*, 3*d* near the hub 1. This crease 2*d*, 3*d* gives the blades the initial large angle which tapers to a smaller angle.

Reiterating, the cord is the angle which the blades 2, 3 would make with the disk of the rotation, if they did not have a curved cross-section. However, clearly the blades 2,3 do have a curved cross section. The camber line is defined as the curved cross-sectional line at each radius of the blades 2,3. As the air hits the blade at the leading edge 2*b*, 3*b*, the air is perpendicular to the blade. To develop the pressure, the blade turns with the camber line so that the trailing edge 2*c*, 3*c* is at a greater angle with the disk of rotation than the leading edge 2*b*, 3*b*. For example, the leading edge would be at a 5° angle with the disk of rotation, and the trailing edge would be at a 25° angle with the disk of rotation.

While the size of the blades is of course variable, it was found for the main blade 2 that a 24" radius blade worked well (48" diameter). Additionally, it was found that, if the main blade 2 was 5" wide at its widest point, it performed well.

An auxiliary blade 3 which performed well had a radius of 12" with the corresponding opposite blade forming a 24" diameter. At its widest point, it was found that, if the small blade was 2½ it performed well The auxiliary blades 3 of the high specific speed fan propeller also aid in balancing the propeller. In propellers of the related art which do not have auxiliary blades, it is desired to place a balancing weight on a surface between the blades to balance the propeller. However, clearly no surface for placing such weight exist. The auxiliary blades 3 of the present invention serve this function.

Moreover, the auxiliary blades 3 of the inventive high specific speed fan propeller aid in cooling the fan motor as well as enable uniform pressure to be developed over the whole disk of rotation. The auxiliary blades also make it possible for a direct drive motor to be efficiently used.

While the invention has been illustrated and described in detail respectively in the drawings and foregoing description, it will be recognized that many changes and modifications will occur to those skilled in the art. For example, the material of which the blades are made, the blade angles, the number of blades and the speed to which the propeller is suited may all be varied. Therefore, the appended claims are intended to cover any such changes and modification which fall within the true spirit and scope of the invention.

I claim:

1. A high specific speed fan propeller, comprising:

a hub having attachment means for connecting the propeller to a turning part;

no more than two main blades attached to the hub and extending radially a first distance therefrom, and at least two auxiliary blades attached to the hub and extending radially a second distance therefrom, the first distance being substantially greater than the second distance.

2. The high specific speed fan propeller of claim 1, wherein the propeller has two main blades and four auxiliary blades.

3. The high specific speed fan propeller of claim 1, wherein the blades are made of sheet metal.

4. The high specific speed fan propeller of claim 3, wherein the blades are made of steel sheet metal.

5. The high specific speed fan propeller of claim 1, wherein each main blade has a corresponding main blade extending in an opposite direction from the hub;

wherein each auxiliary blade has a corresponding auxiliary blade extending in an opposite direction from the hub; and wherein each pair of corresponding auxiliary and main blades is formed from a piece of sheet metal having a middle portion, the middle portion being attached to the hub, the piece of sheet metal extending from a tip of one blade to the tip of the corresponding blade.

6. The high specific speed fan propeller of claim 1, wherein each auxiliary and main blade has a trailing edge and a leading edge each leading edge being at a first angle with a disk of rotation and each trailing edge being at a second angle with the disk of rotation, the second angle being greater than the first angle.

7. The high specific speed fan propeller of claim 1, wherein the chord of the main and auxiliary blades is at a first angle with the disk of rotation at the tip of the blade and at a second angle with the disk of rotation towards the hub, the second angle being greater than the first angle; and wherein the main and auxiliary blades taper and the angle the chord makes with the disk of rotation gradually changes from the second angle towards the hub to the first angle at the tip.

* * * * *